US005218266A

United States Patent [19]

Lee

[11] Patent Number: 5,218,266

[45] Date of Patent: Jun. 8, 1993

[54] COLOR PICTURE TUBE HAVING RESIDUE ELECTRON REMOVING ASSEMBLY

[75] Inventor: Jae C. Lee, Suwon, Rep. of Korea

[73] Assignee: Samsung Electron Devices Co., Ltd., Kyongki, Rep. of Korea

[21] Appl. No.: 745,347

[22] Filed: Aug. 15, 1991

[30] Foreign Application Priority Data

Aug. 18, 1990 [KR] Rep. of Korea ..... 90-12730

[51] Int. Cl.[5] ..... H01J 29/07

[52] U.S. Cl. ..... 313/407; 313/404

[58] Field of Search ..... 313/402, 404, 406

[56] References Cited

U.S. PATENT DOCUMENTS 4,739,215 4/1988 Adamski et al. ..... 313/402
4,829,212 5/1989 Serio et al. ..... 313/406

FOREIGN PATENT DOCUMENTS 2622695 12/1977 Fed. Rep. of Germany ..... 313/406
60-70640 4/1985 Japan .
61-237339 10/1986 Japan .

*Primary Examiner*—Sandra L. O'Shea
*Attorney, Agent, or Firm*—Cushman Darby & Cushman

[57] ABSTRACT

A color picture tube is provided with a residue electron removing assembly. The residue electron removing assembly includes a contact spring which is installed between a stud pin and a hook spring connected to a frame. Opposite ends of the contact spring resiliently contact an aluminum layer of a panel and a graphite layer of a funnel, respectively. Assembly supporting pieces and embossing portions on the contact spring grasp the hook spring to support it. With this structure, residue electrons which collide with a shadow mask are discharged through the frame and the hook spring, while residue electrons which collide with a phosphor layer after passing through the shadow mask are discharged through the aluminum layer to the contact spring to the graphite layer and eventually to the outside of the picture tube.

6 Claims, 3 Drawing Sheets

COLOR PICTURE TUBE HAVING RESIDUE ELECTRON REMOVING ASSEMBLY

BACKGROUND OF THE INVENTION

1. Field of the Invention

The present invention relates to a color picture tube provided with a residue electron removing assembly, and particularly to a color picture tube in which there is provided a residue electron removing assembly functioning as a bridge for discharging residue electrons which land on a phosphor plated screen and those remaining on a shadow mask, as electrons emitted form an electron gun pass through the color sorting shadow mask to the phosphor plated screen.

2. Description of the Related Art

Generally, in a shadow mask type color picture tube, electron beams emitted from an electron gun cross one another at numerously large number of holes formed on a shadow mask. The beams collide with aligned phosphor dots (or stripes) so that he phosphor plated screen produces the three basic colors.

In such an electron irradiating operation, the brightness of the luminescent color phosphors on the conductive layer is determined by the intensity of the electron beams emitted by an electron gun. When the electron beams collide with the phosphors, if the electron beams land on a periphery of the phosphors or near a black matrix, there occurs a negative charge repulsion phenomenon. This results in residue charges being formed between the shadow mask and the phosphors. These residue charges make the image on the screen appear severely unstable and unclear. A circular strip may also be seen on the image.

Further, as the light emitting condition of the image deviates from its normal state, a phenomenon where a beam path is deflected as it travels through the shadow mask, (i.e., a regrouping phenomenon) is generated.

In an attempt to overcome the above described disadvantages, a structure as shown in FIG. 1 has been proposed. A first graphite layer 6 is formed between stud pin 7 and aluminum layer 5, with stud pin 7 being fixedly secured on one side of the inner face of panel 1. Aluminum layer 5 is coated on phosphor layer 4 of panel 1. A frame 10 which supports opposite sides of shadow mask 9 is fixedly secured on stud pin 7 through hook spring 8. Inner shield 12 which is disposed within the color picture tube is fixed to frame 10 by means of clip 11. One end of contract spring 13 is secured to inner shield 12 by spot-welding thereto and the other end of the contact spring 13, which is bent, is made to elastically abut on second graphite layer 14 which is coated on an inner face of funnel 2.

In the above conventional structure, residue electrons which remain on shadow mask 9 after failing to pass the shadow mask 9, flow through frame 10 (or inner shield 12), to contact spring 13, and to second graphite layer 14. Similarly, residue electrons remaining after collision with phosphor layer 4, flow through aluminum layer 5, to first graphite layer 6, to stud pin 7, to hook spring 8, to frame 10, to contact spring 13, and to second graphite layer 14 to the outside of funnel 2. Thus, contact spring 13 serves as a bridge such that residue electrons are discharged from shadow mask 9 through frame 10 to inner shield 12 and finally to the outside.

First graphite layer 6 serves as a bridge such that residue electrons are discharged from phosphor layer 4 through aluminum layer 5, to hook spring 8, to frame 10 and to contact spring 13 to the outside. In the above conventional structure, the major disadvantage lies in that the transfer path for residue electrons consists of an assembly having a large number of components.

Furthermore, when forming first graphite layer 6 which acts as a bridge, a graphite slurry is spread by way of a brush or the like between aluminum layer 5 (coated on phosphor layer 4) and stud pin 7 (fixed to the inner face of panel 1). The spread graphite slurry is then dried. However, in spreading the graphite slurry, the graphite slurry not only can intrude into the fluorescent effective area of aluminum layer 5, but the graphite slurry can also be detrimentally sprinkled by careless manipulation of the brush.

In securing contact spring 13, contact spring 13 is to be spot-welded, for best operation, to inner shield 12 at least on 4 spots, and wherein inner shield 12 is secured to frame 10 by means of clip 11. However, in performing the necessary spot-weldings, spark particles remain within a picture tube, and these particles can block the holes of shadow mask 9.

Further, there are also other proposed structures such as the color picture tube manufacturing process of Japanese Patent Laid-open No. SHOWA 60-70640, and the color picture tube assembly of Japanese Patent Laid-open No. SHOWA 61-237339. In these references, there is shown a contact spring which is directly spot-welded to the frame, or secured by means of a clip, and the leading end of the contact spring is elastically contacted to the second graphite layer of the panel. When spot-welding is necessary, the above described spark particle drawback remains and can block the holes in the shadow mask. Similarly, since a clip is used, the problem of non-economic multiple components still exists.

U.S. Pat. No. 4,829,212 proposes yet another structure which is to be described below. That is, the electrical connecting assembly of the interior of a CRT, a known construction, is constituted such that one side of the conductive layer of the panel is connected through a contact spring to the stud pin, so that the contact spring should simply electrically connect the shadow mask to the conductive layer of the panel. In this construction, however, there arises the problem that some additional means has to be provided in order to discharge the residue electrons to the outside.

SUMMARY OF THE INVENTION

The present invention is intended to overcome the above described disadvantages of the conventional techniques.

Therefore it is an object of the present invention to provide a color picture tube having a residue electron removing assembly, wherein residue electrons remaining on a phosphor layer and residue electrons remaining on a shadow mask can be directly discharged to the outside in a manner which shortens the electron transfer path.

In achieving the above object, the color picture tube having a residue electron removing assembly according to the present invention is constituted such that opposite ends of a contact spring are curved in a round form like a hook. The curved opposite ends of the contact spring are elastically contacted to an aluminum layer on the inside of the panel and to a graphite layer on the inside of the funnel respectively. A punching hole is formed at the center of the contact spring in the size of the circumference of a stud pin. An embossing portion and a supporting piece are formed at opposite sides of the punching hole of the contact spring respectively, thereby firmly supporting and engage-contacting the opposite sides of the hook spring (fitted to the stud pin) in order to secure the frame to the stud pin.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENTS

Figure 1:
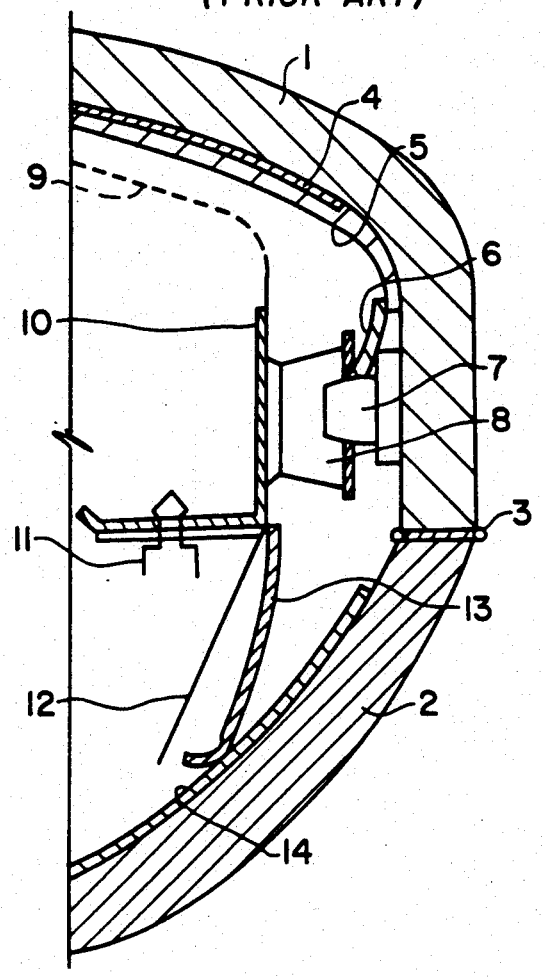
FIG. 1 (PRIOR ART)
FIG. 1 is a sectional view of a part of the conventional color picture tube.
Figure 2:
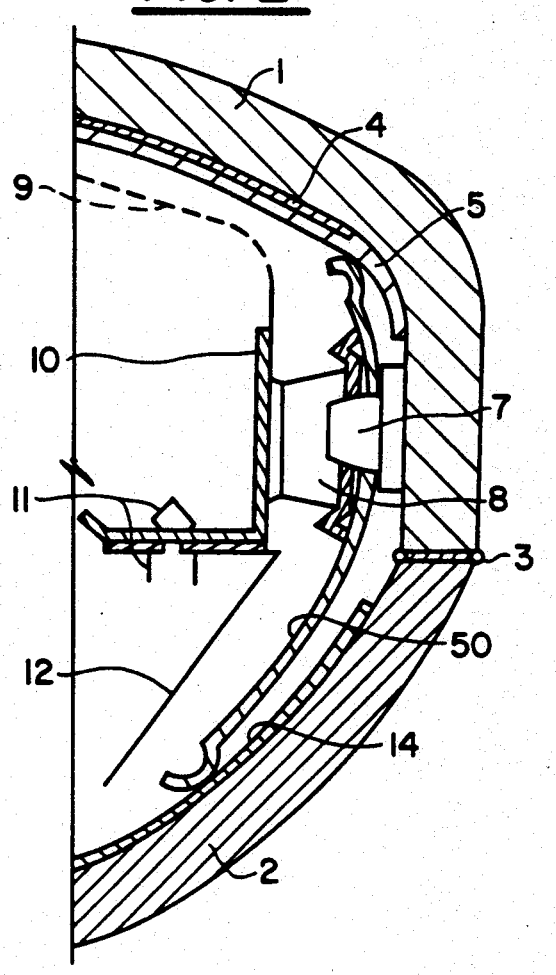
FIG. 2 is a sectional view of a part of the color picture tube according to the present invention.

Referring to FIG. 2, this drawing shows the state that a contact spring is in when installed to the color picture tube according to the securing method of the present invention.

In this drawing, reference code 50 indicates a contact spring, and this contact spring 50 is connected to one side of phosphor layer 4 of panel 1 and to graphite layer 14 of funnel 2.

Figure 3:
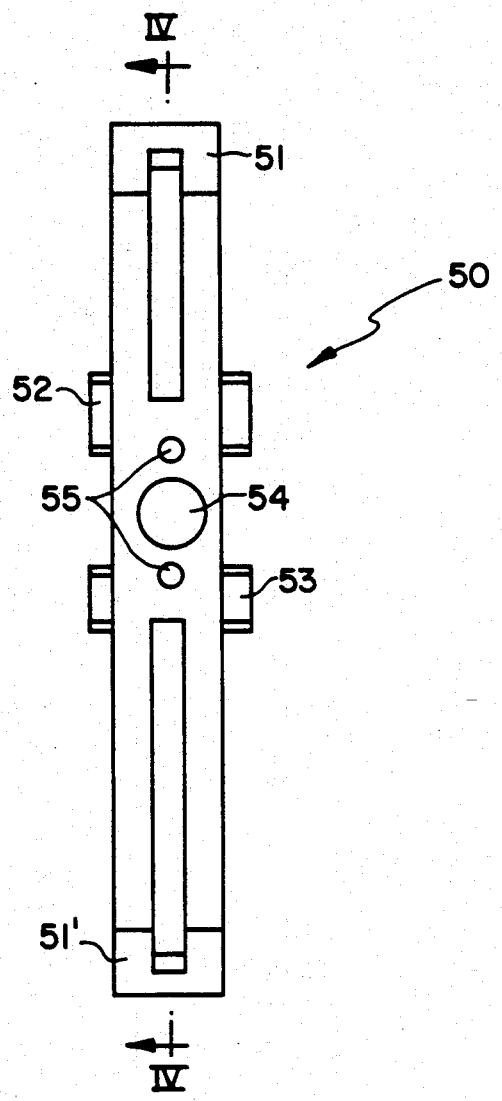
FIG. 3 is a front view of the contact spring according to the present invention.
Figure 4:
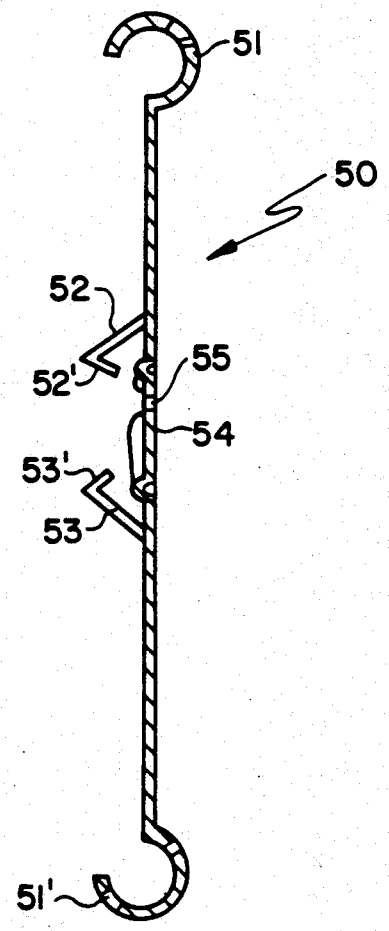
FIG. 4 is a sectional view taken along the line IV—IV of FIG. 3.

As shown in FIGS. 3 and 4, punching hole 54 is formed at the center of contact spring 50, and this hole is for inserting stud pin 7 of panel 1. Embossing portions 55 are formed at a certain distance from the opposite sides of punching hole 54. Each embossing portion 55 elastically supports one side of a hook spring 8 (the side facing toward an inner face of panel 1 in a state settled by stud pin 7), with hook spring 8 being used for frame 10 (on which shadow mask 9 is weld-fixed) supported by stud pin 7.

Supporting pieces 52, 53 are formed at a certain distance from the opposite sides of each of the embossing portions 55, and the leading ends of them are provided with engaging rings 52', 53', so that they should elastically support the other side of hook spring 8 (the side facing toward frame 10). Meanwhile, the opposite ends of the contact spring 50 are provided with contact portions 51,51' in a round form like a hook so that they should be elastically contacted to both aluminum layer 5 of the inside of panel 1 and graphite layer 14 of the inside of funnel 2, with panel 1 and funnel 2 being bonded together by way of frit glass 3 to form a color picture tube.

Contact spring 50 constituted as above will now be described as to its assembling method. That is, as shown in FIG. 2, punching hole 54 which is formed at contact portion 51 at one end of contact spring 50, is contacted to the surface of aluminum layer 5 of panel 1. Then a fastening hole (not shown), which is formed on hook spring 8 connected to frame 10 for supporting shadow mask 9, is press-fitted to stud pin 7 which has passed through punching hole 54 of contact spring 50. Under this condition, the fastening hole tends to depart from stud pin 7 due to the restoring force of hook spring 8. However, under this condition, engaging rings 52',53' which are formed on the leading ends of supporting pieces 52,53 of contact spring 50 grasp hook spring 8 which is firmly secured to stud pin 7.

After a determination is made that hook spring 8 is firmly secured between supporting pieces 52,53 of contact spring 50 and embossing portion 55, panel 1 and funnel 2 are bonded together by way of frit glass 3 in a known method, completing the assembling process.

With the color picture tube sealed to a tube form, contact portion 51 of contact spring 50 is in contact with aluminum layer 5 of the inside of panel 1. Contact portion 51' of contact spring 50 is pushed toward the location of the inner shield 12 due to the bell-shaped portion, i.e., funnel 2 so that contact portion 51' is in contact with graphite layer 14 of the inside of funnel 2.

Now the color picture tube provided with a residue electron removing means assembled according to the present invention as above will be described as to its operation and effect.

Electron beams emitted from an electron gun pass through shadow mask 9 and collide onto phosphor layer 4, thereby forming an image on the screen. Under this condition, residue electrons which remain on phosphor layer 4 are transferred through aluminum layer 5 and contact spring 50 to graphite layer 14. Similarly, residue electrons which have failed to pass through the holes of shadow mask 9 and remain thereon are discharged through frame 10, to hook spring 8, to contact spring 50, to graphite layer 14 and passed on to the outside, thereby shortening an electron transfer path.

Figure 5:
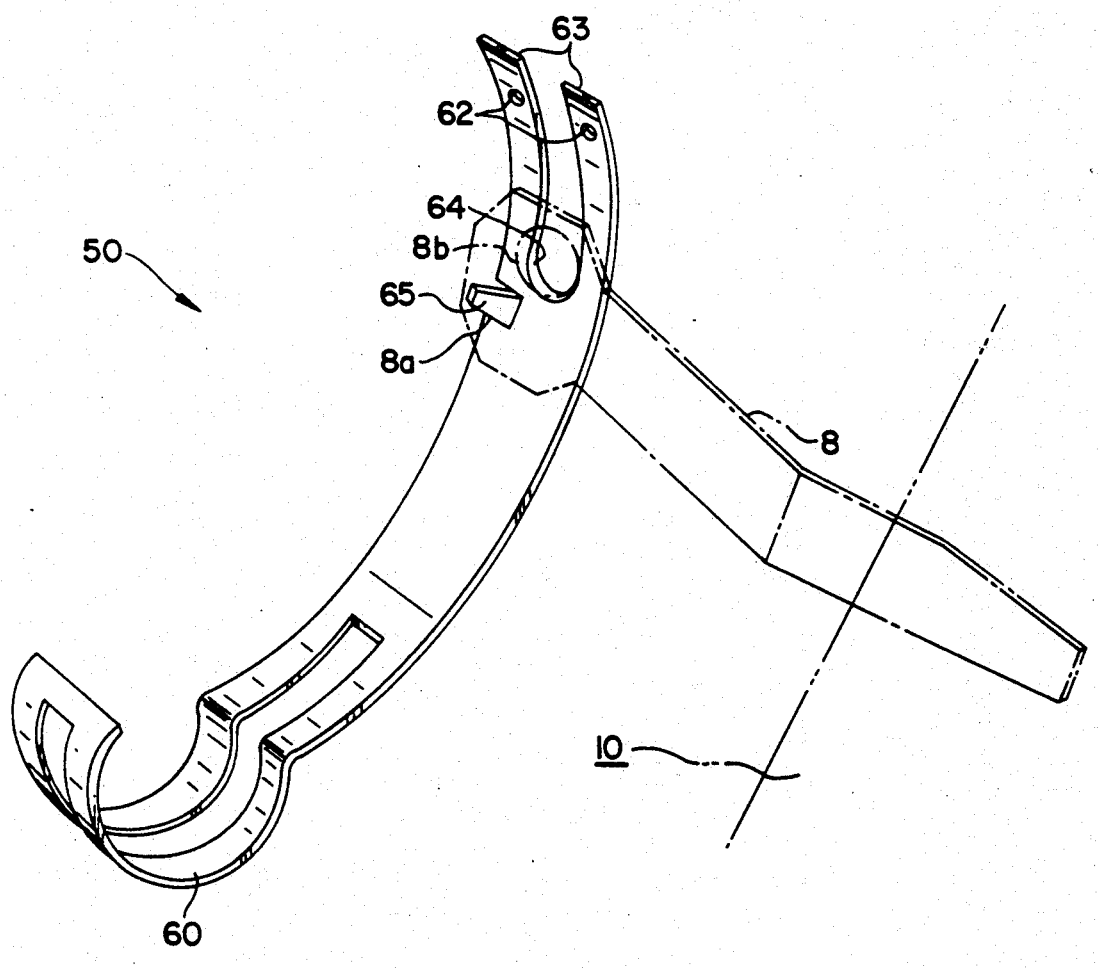
FIG. 5 is a perspective view showing another embodiment of the contact spring of the present invention.

FIG. 5 is a perspective view showing another embodiment of contact spring 50 according to the present invention.

As shown in this drawing, leading end 60 of the contact spring 50 is provided with a circular shape like a hook at one end. At the other end, it is provided with two legs 63 on which embossing portions 62 are formed respectively, with an arcuate portion 64 being formed between the two legs 63. Near one end of the arcuate portion 64, there is formed a protuberance 65 which is to be fitted to an engaging hole **8*a* of hook spring 8**.

In such a structure, hook spring 8, which is secured to frame 10 for supporting shadow mask 9, is positioned so as to perpendicularly cross the contact spring 50. Protuberance 65 of contact spring 50 is fitted into engaging hole **8*a* of hook spring 8 so that the arcuate portion 64 of contact spring 50 is made even with one edge of a fastening hole 8*b*. In this state, if stud pin 7 is inserted into fastening hole 8*b*, and if panel 1 and funnel 2 are bonded together, then one end of contact spring 50 of the present invention is in elastical contact with graphite layer 15 of the inside of funnel 2. Similarly, embossing portion 62 of leg 63 at the other end of contact spring 50 is in elastical contact with aluminum layer 5 on the inside of panel 1**.

This second embodiment of the present invention is an improvement on the ease of assembly of the structure. That is, shadow mask 9 is installed on panel 1 by fitting hook spring 8 to stud pin 7, and arcuate portion 64 of contact spring 50 is fitted to stud pin 7 completing the assembling in yet a more simpler manner.

Contact spring 50 according to the second embodiment of the present invention is provided with two legs 63 at one end of it, with an embossing portion 62 being provided on each of the two legs 63. Therefore, a firm contact with the inside of the panel 1 is assured, and the description of the residue electron transferring path for this second embodiment will be omitted, because it is same as that of the first embodiment.

According to the present invention as described above, contact spring 50 and stud pin 7 are securely fitted together to provide a bridge for discharging residue electrons which remain on both shadow mask 9 and phosphor layer 4.

In addition, opposite ends of contact spring 50 are formed in direct contact with aluminum layer 5 of panel 1 and graphite layer 14 of funnel 2. As a result, an improvement in the assembling efficiency of a picture tube is expected. The number of components involved in electron discharging is reduced, the discharge path is shortened, and the manufacturing cost is therefore reduced.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claim.

What is claimed is:

1. A residue electron removing assembly in a color picture tube comprising:

a shadow mask;

a frame for supporting said shadow mask;

a stud pin;

a hook spring connected at one end to the frame supporting said shadow mask and at the other end to the stud pin; and a contact spring extending from said installed between said frame and said stud pin, said contact spring including:

a punching hole for passing said stud pin therethrough and securing said contact spring to said frame;

contact portions provided at opposite ends of said contact spring, including a first contact portion forming a resilient contact with an aluminum layer of a panel and a second contact portion forming a resilient contact with a graphite layer of a funnel;

at least one embossing portion formed a predetermined fixed distance from said punching hole so as to resiliently support one side of said hook spring; and two supporting pieces, each formed a certain fixed distance from opposite sides of each of said at least one embossing portion, said two supporting pieces having corresponding engaging rings for firmly securing said hook spring to the stud pin when press-fitting the hook spring to the stud pin which is passed through the punching hole of the contact spring.

2. A residue electron removing assembly as claimed in claim 1, wherein supporting pieces are formed in an inclined position at a certain distance form two of said at least one embossing portion.

3. A residue electron removing assembly as claimed in claim 1, wherein said contact portions are formed having a round hook-shaped construction.

4. A residue electron removing assembly as claimed in claim 1, wherein said supporting pieces are provided with said corresponding engaging rings at outwardly protruding leading ends thereof.

5. A residue electron removing assembly as claimed in claim 1, wherein at least one of said contact portions includes a two legged construction with embossing portion sat the corresponding leading end.

6. A residue electron removing assembly as claimed in claim 5, wherein said corresponding leading end includes an outwardly facing arcuate portion and the legs of said two legged construction contact portion correspond to the legs of said arcuate portion.

* * * * *